US006079176A

United States Patent [19]

Westra et al.

[11] Patent Number: 6,079,176

[45] Date of Patent: Jun. 27, 2000

[54] INSULATED CONCRETE WALL

[76] Inventors: Albert P. Westra; Gregory A. Westra, both of 16620 Cedar Grove Rd., Sparks, Md. 21152

[21] Appl. No.: 09/065,285

[22] Filed: Apr. 23, 1998

Related U.S. Application Data

[60] Provisional application No. 60/060,364, Sep. 29, 1997.

[51] Int. Cl.[7] ..... E04G 17/06

[52] U.S. Cl. ..... 52/404.2; 52/309.11; 52/309.12; 52/309.17; 52/378; 52/407.4; 52/699; 52/700; 52/701; 52/703; 52/713; 249/15; 249/38; 249/40; 249/41; 249/46; 249/190; 249/213; 249/214; 249/216

[58] Field of Search ..... 52/698, 699, 700, 52/701, 703, 707, 713, 404.2, 404.5, 407.4, 378, 379, 309.8, 309.11, 309.12, 309.17; 249/207, 213, 214, 216, 190, 15, 38, 40, 41, 46

[56] References Cited

U.S. PATENT DOCUMENTS

| | | | |
|---|---|---|---|
| 1,702,671 | 2/1929 | Toogood | 249/216 X |
| 2,256,961 | 9/1941 | Pearson et al. | 52/407.4 |
| 3,362,678 | 1/1968 | Bowden | 249/214 |
| 3,438,161 | 4/1969 | Koch | 249/40 X |
| 4,329,821 | 5/1982 | Long et al. | 249/38 X |
| 4,541,211 | 9/1985 | Garrett | 52/309.12 X |
| 4,889,310 | 12/1989 | Boeshart | 249/216 X |
| 4,936,540 | 6/1990 | Boeshart | 249/216 |
| 4,938,449 | 7/1990 | Boeshart | 249/216 |
| 5,657,600 | 8/1997 | Mensen | 52/309.12 X |
| 5,852,907 | 12/1998 | Tobin et al. | 249/216 X |
| 5,861,105 | 1/1999 | Martineau | 249/190 X |

FOREIGN PATENT DOCUMENTS

| | | | |
|---|---|---|---|
| 561345 | 4/1975 | Switzerland | 249/213 |

*Primary Examiner*—Laura A. Callo
*Attorney, Agent, or Firm*—Bartlett & Sherer; Ronald B. Sherer

[57] ABSTRACT

A system for insulating only the interior surface of a concrete wall to be poured between a pair of interior and exterior wall forms. The system includes horizontally extending elongated tie strips which connect to each of the wall forms to hold the wall forms spaced apart, a single layer of insulation positioned in contact with the interior wall form, and a plurality of connectors for securing the single layer of insulation to only the interior surface of the concrete wall. The connectors include an enlarged head portion which engages the insulation and a web portion of smaller cross section which extends through apertures in the insulation and into the space between the wall forms, the web portion including openings for the passage of concrete therethrough.

3 Claims, 3 Drawing Sheets

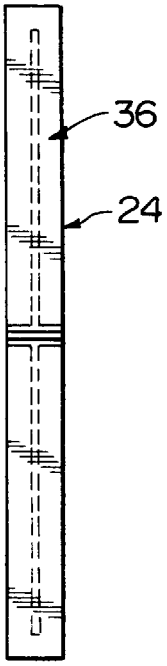
FIG. 6
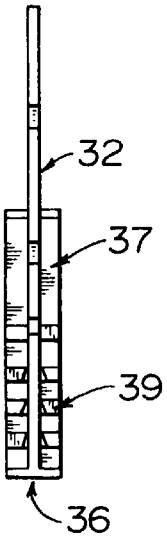
FIG. 7
FIG. 8
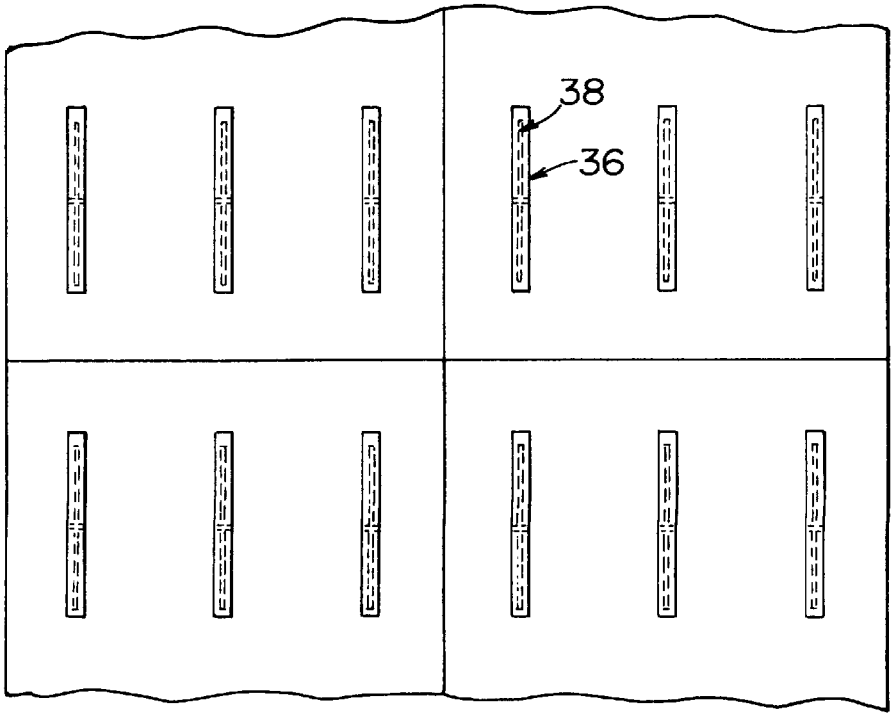

INSULATED CONCRETE WALL

RELATED APPLICATION

This application is a complete application based upon Provisional Application. Ser. No. 60/060,364 filed Sep. 29, 1997 the priority date of which is hereby claimed.

FIELD OF THE INVENTION

The present invention relates to poured concrete walls and, more particularly, to poured concrete walls including a layer of thermal insulation in which the insulation layer is secured to the concrete wall at the time of pouring the concrete.

BACKGROUND

Concrete walls are commonly formed by pouring concrete between inner and outer forms and, after hardening, insulation materials may be added to the concrete walls. In order to do so, frame members may be applied to the concrete wall, such as by using pneumatic guns and concrete nails, and then the insulating material may be secured to the frame members. Alternatively, the insulation may be secured to the concrete wall by concrete nails. Such multi-step assembly procedures are both time consuming and costly. Thus, there has long been a need for a system and a method whereby poured concrete walls may be formed and insulated at the same time in one step.

SUMMARY

The present invention provides an apparatus and method for securing an insulation layer in place while the concrete is poured between conventional forms, and for continuing to secure the insulation layer to the poured concrete wall after the forms have been removed.

BRIEF DESCRIPTION OF THE DRAWINGS

FIG. 6 is a front plan view of the support element taken along line 6—6 of FIG. 5;

FIG. 7 is a top plan view of the support element taken along line 7—7 of FIG. 5;

FIG. 8 is an elevational view of a plurality of insulation panels secured to the concrete wall by a plurality of support elements.

DETAILED DESCRIPTION

Figure 1:
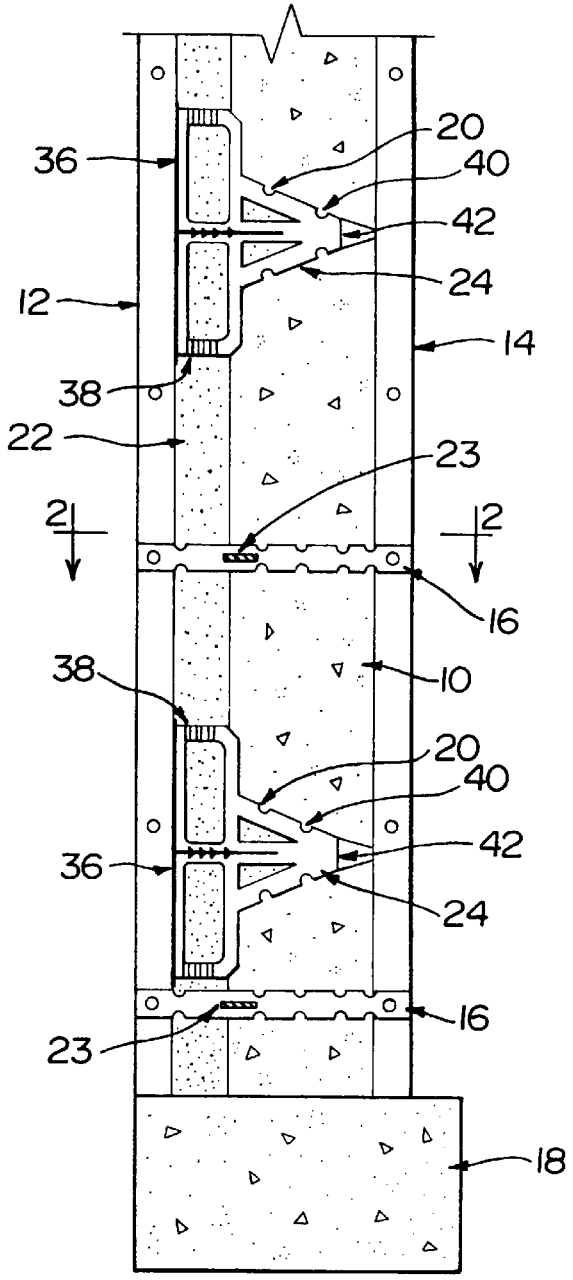
FIG. 1 is a sectional view of a poured concrete wall with a thermal insulation layer secured thereto.
Figure 3:
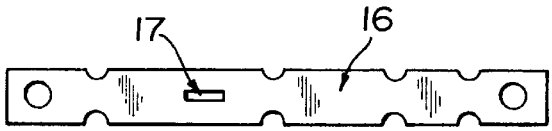
FIG. 3 is an enlarged side-elevational view of one tie strip.

Referring first to FIG. 1, numeral 10 designates a concrete wall which has been poured between first and second conventional forms 12 and 14. Forms 12, 14 are held together by metal strips or ties 16 as in conventional practice. However, as shown most clearly in FIG. 3, each of ties 16 includes a non-conventional slot 17 for a purpose hereinafter described. Numeral 18 represents a conventional footing for supporting the wall, and numeral 20 represents a plurality of conventional reinforcing bars ("rebar") which extend horizontally through the poured concrete to add strength to the wall.

The structure described thus far is typical of the manner of forming poured concrete walls. After the concrete hardens, forms 12 and 14 are removed and the concrete wall is complete. If insulation is to be added, frame members (not shown) must be secured to the wall, or sheets or rolls of insulation must be secured by pneumatic nailing guns. As previously stated, this double-step procedure is both time consuming and costly.

Figure 2:
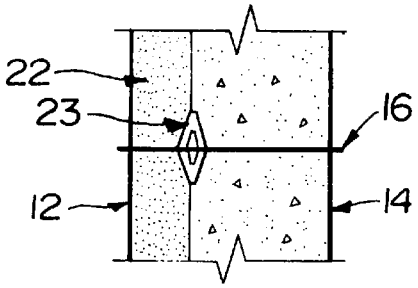
FIG. 2 is a cross-sectional view taken along line 2—2 of FIG. 1.
Figure 4:
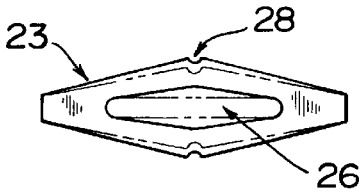
FIG. 4 is a top plan view of a wedge which is inserted into the tie strip.

In the present invention, layers or panels of insulation 22 are secured in place before the concrete is poured between forms 12, 14. The means for securing the insulation in place during the pouring of the concrete comprise clips or wedges 23 and anchors or connectors 24. Clips or wedges 23, hereinafter wedges, are shown in detail in FIGS. 2 and 4. Each wedge comprises a molded piece of plastic, such as polypropylene, which is in the form of a double-ended V-shape with an open hole 26 in the central region. As such, the wedges are flexible and resilient so that they may be squeezed together in the center portion and inserted into slots 17 of ties 16. Upon insertion, the center portions of the wedges expand such that grooves 28 lock in ties 16 and the wedges extend horizontally. As shown most clearly in FIG. 2, approximately one-half of each wedge becomes embedded in the insulation panel, and the other half becomes embedded in the poured concrete. As a result, the insulation panels become locked to fixed ties 16 so that the lightweight panels cannot "float" upwardly when the concrete is poured.

In addition to ties 16 and wedges 23, the present invention provides anchors or connectors 24 as shown in FIGS. 1 and 5–7. Preferably, connector elements 24 are in the form of a web portion 32 having openings 34 so that the poured concrete passes through and fills the openings as shown in FIG. 1. Thus, as the concrete hardens, connectors 24 become bound and locked in the concrete.

As further shown most clearly in FIGS. 1 and 5–7, each connector 24 includes an enlarged head portion 36 which extends laterally and vertically at a right angle relative to the web portion. Thus, when the web portion of each connector passes through a slot 38 in the insulation panel as shown in FIGS. 1 and 8, the panel is retained by head portion 36 while the web portion is retained in and by the concrete. In the preferred embodiment, it will be understood that the area of the insulation surrounding slot 38 may be recessed or counter-sunk such that the exposed surface of the connector head is flush with the surface of the insulation. However, the thickness of the head portion is only in the order of ¼ inch or less such that counter-sinking is not necessary.

Figure 5:
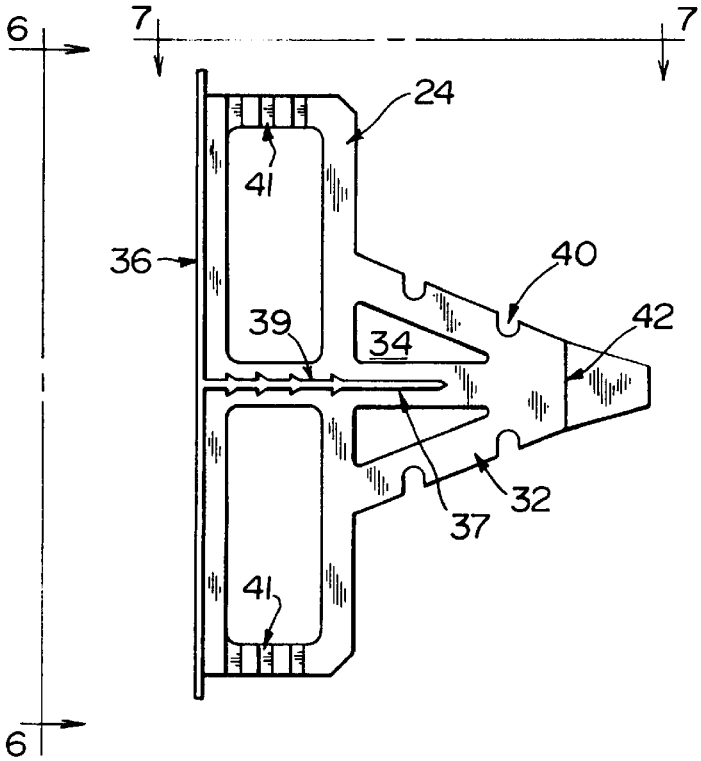
FIG. 5 is an enlarged, side elevational view of one form of support element for securing the insulation layer to the concrete wall prior to, during, and after the concrete is poured.

Also in the preferred embodiment, stiffening side bars or ribs 37 may be added as most clearly shown in FIGS. 5 and 7, and the stiffening ribs may be provided with barbs 39 for engaging in insulation layer 22. Also, the upper and lower portions of connectors 24 may be provided with barbs 41 which further engage and hold the insulation panel in place. In addition, in order to accommodate walls of either 6 or 8 inches in thickness, the horizontal length of connectors 24 may be manufactured of a uniform 8 inch length, and with grooves 42 as shown in FIG. 5 near the tip of the connector such that the tip may be easily broken off for 6 inch walls.

In the foregoing description, connectors 24 may be held in place during the concrete pouring by virtue of a tight frictional fit between the web portion 32 and slot 38 of the insulation panel and the frictional engagement of barbs 39 and 41. However, a substantially greater securing of the connectors may be effected by providing one or more notches, grooves or hook portions 40 as shown in FIGS. 1 and 5. These hook portions may be engaged by rebar 20 so as to positively lock connectors 24 in place before, during and after the concrete is poured.

Connectors 24 may be composed of any rigid material, but they are preferably composed of molded plastic such as for example, polypropylene or polyethylene. Such materials may be easily molded, are of low thermal conductivity and are low cost. Most importantly, they provide an excellent medium for receiving nails, screws, staples or other means through heads 36 for securing the later installation of additive wall materials such as plaster board, paneling or other finishing layers.

Insulation layer 22 may be composed of any commercially available material of low thermal conductivity, but is preferably composed of rigid panels of expanded or extruded polystyrene. In addition to the thermal insulation value of such panels, their inherent properties provide a vapor barrier and their thermal properties are not deteriorated by moisture.

From the foregoing description of one preferred embodiment it will be apparent that numerous variations in the details will be readily apparent to those skilled in the art. Accordingly, it will be understood that the foregoing description is purely illustrative of the principles of the invention, and that the invention is not intended to be limited other than as expressly set forth in the claims interpreted under the doctrine of equivalents.

What is claimed is:

1. In a system for insulating only the interior surface of a concrete wall to be poured in between a pair of interior and exterior wall forms composed of non-insulating material, the invention comprising:

(a) horizontally extending tie means for connection at opposite ends to each of the wall forms for holding the wall forms horizontally spaced-apart;

(b) a single layer of insulation, said single layer of insulation being the only insulation layer for the concrete wall and being positioned in the space between the spaced-apart wall forms and being positioned only in contact with the interior wall form;

(c) said single layer of insulation having a plurality of apertures;

(d) a plurality of connectors, each of said connectors having an enlarged head portion and a web portion of smaller cross-section than said head portion;

(e) each of said web portions having a plurality of openings for the passage of concrete therethrough, and said web portions being of a cross-sectional size for passing through said apertures and into the space between the wall forms; and (f) said head portions engaging said insulation surrounding said apertures for holding said single layer of insulation in place while the concrete is poured into the space between the forms and flows through said plurality openings in each of said web portions for securing said single layer of insulation to only the interior surface of the concrete wall.

2. The invention of claim 1 further including:

(a) horizontally extending slot in each of said tie means; and (b) resilient wedge means of a size and shape for extending through said slots in said tie means and frictionally engaging said single layer of insulation for additionally securing said single layer in place.

3. The invention of claim 2 wherein said resilient wedge means are composed of plastic with a central opening and resilient sides for engaging said tie means in said slots.

* * * * *